US006789616B2

(12) United States Patent
Nakano

(10) Patent No.: US 6,789,616 B2
(45) Date of Patent: Sep. 14, 2004

(54) CYLINDER-TYPE HEAT EXCHANGER

(75) Inventor: Kimiaki Nakano, Hadano (JP)

(73) Assignee: Toyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 10/301,145

(22) Filed: Nov. 21, 2002

(65) Prior Publication Data

US 2003/0131978 A1 Jul. 17, 2003

(30) Foreign Application Priority Data

Nov. 30, 2001 (JP) ..... 2001-367748

(51) Int. Cl.[7] ..... F28D 9/04
(52) U.S. Cl. ..... 165/167; 165/165; 165/DIG. 357
(58) Field of Search ..... 165/164, 165, 165/166, 167

(56) References Cited

U.S. PATENT DOCUMENTS 1,790,036 A * 1/1931 Wiltse ..... 210/168
3,255,818 A * 6/1966 Beam, Jr. et al. ..... 165/166
3,412,787 A * 11/1968 Milligan ..... 165/153
4,301,862 A * 11/1981 McAlister ..... 165/165
5,797,449 A * 8/1998 Oswald et al. ..... 165/165

* cited by examiner

*Primary Examiner*—Allen Flanigan
(74) *Attorney, Agent, or Firm*—Jordan and Hamburg LLP

(57) ABSTRACT

A cylinder-type heat exchanger including cells spirally wound between an inner cylinder and an outer cylinder which are concentrically arranged. Each cell includes a first plate and a second plate which are in contact with each other. The first and second plates each have several inlets and outlets arranged in parallel at opposed ends in the axial direction, with communication portions being arranged between the inlets and between the outlets. A first flow passage through which a first fluid flows is formed on the confronting sides of the first plate and the second plate, while a second flow passage through which a second fluid flows is formed on the non-confronting sides of the first plate and the second plate.

15 Claims, 10 Drawing Sheets

CYLINDER-TYPE HEAT EXCHANGER

BACKGROUND OF THE INVENTION

1. Field of the Invention

The present invention relates to a heat exchanger for use as, e.g., a recuperator (high-temperature regeneratve heat exchanger) for a gas turbine.

2. Description of the Related Arts

A conventional recuperator for a gas turbine has been constructed as shown in FIG. 20 by way of example.

FIG. 19 is a top plan view of an element 23 of the recuperator, with FIG. 20 being a schematic longitudinal section of the recuperator having a multiplicity of elements 23 which are stacked one upon another.

The element 23 of the recuperator consists of a pair of dish-shaped plates 24 and 25 which are oppositely disposed on top of the other, the plates each comprised of a press mold of a stainless steel plate having an inlet 6 and an outlet 7 formed at opposed ends, with raised portions 26 at the rims of the inlet 6 and outlet 7. The multiplicity of elements are placed one upon another such that their respective inlets and outlets are in communication with one another. Reinforcement plates 27 and 28 having an increased thickness are arranged at vertically opposed ends in the stacked direction, with the reinforcement plate 27 on one hand having a pair of openings 13 in communication with the inputs 6 and the outlets 7. The plates 24 and 25 hitherto used have internal and external surfaces with high-temperature resistant brazing materials.

With such components being assembled, the entirety is introduced into a furnace at high temperature to melt the brazing materials, and the molten brazing materials are then cooled and solidified so that the components are integrally brazed to each other. A second fluid 11*a* is delivered through the opening 13 of the reinforcement plate 27 to the inlet 6 of each of the elements 23. The second fluid 11*a* then flows through flat second flow passages 11 defined between internal surfaces of each plate pair and via the outlet 7 to the exterior. A first fluid 10*a* flows through first flow passages 10 defined between external surfaces of adjacent plate pairs such that heat exchange takes place between the first fluid 10*a* and the second fluid 11*a*. At that time, the second fluid 11*a* is in the form of a low-temperature high-pressure air (of the order of 200° C.) delivered into the interior of each element 23 whilst the first fluid 10*a* is a high-temperature low-pressure gas (of the order of 700° C.) flowing therethrough.

Since the gas turbine has a circular periphery, the internally flowing high-temperature gas flows through the tubular interior having a circular section. However, the periphery of the conventional recuperator for a gas turbine is generally rectangular in section, causing mismatching therebetween and impeding a reduction in size.

The conventional recuperator suffers deficiencies that it needs a multiplicity of dish-shaped plates, i.e., increased number of components, making the assembly troublesome. There is also a need to use brazing materials resistant to high temperature of 700° C. or above on the internal and external surfaces of the plates making up each element, i.e., a need for a large quantity of expensive brazing materials.

SUMMARY OF THE INVENTION

It is therefore the object of the present invention to solve the above problems.

In order to achieve the above object, according to an aspect of the present invention there is provided a cylinder-type heat exchanger comprising an inner cylinder and an outer cylinder which are concentrically arranged; and one or more cells disposed between the inner and outer cylinders and spirally wound therebetween; the one or more cells each including a first plate and a second plate in pairs which are in contact with each other; wherein the first and second plates in pairs are each provided with a plurality of circumferentially spaced apart inlets and outlets at opposed ends in the axial direction of the inner cylinder, the plurality of inlets lying within recessed portions formed oppositely in the first and second plates such that the plurality of inlets register with one another and that the plurality of outlets register with one another; wherein communication portions are arranged between circumferentially adjoining inlets and between circumferentially adjoining outlets of the first plate and the second plate; wherein the first and second plates in pairs are provided on their confronting sides with a first flow passage for communication of a first fluid extending in the axial direction, the first and second plates in pairs being provided on their non-confronting sides with a second flow passage for communication of a second fluid extending from the inlets to the outlets in the axial direction; and wherein the second plate of one of radially adjoining cells and the first plate of the other of the radially adjoining cells are in contact with each other at their opposed edges in the axial direction, the recessed portions of the first and second plates confronting each other to form small tank portions for outflow and inflow of the second fluid.

Preferably, the periphery of the outer cylinder is provided with a plurality of openings for outflow and inflow of the second fluid which communicate with the inlets and outlets of the one or more cells.

Preferably, the first plate and the second plate in pairs of each of the one or more cells are securely inlet-to-inlet and outlet-to-outlet welded to each other, the second plate of one of adjoining cells and the first plate of the other of the adjoining cells being securely welded to each other at their opposed edges in the axial direction, with the plates being substantially free from join at remaining portions.

Preferably, the one or more cells are joined at their ends in the winding direction to the periphery of the inner cylinder in a circumferentially spaced apart relationship.

Preferably, the first and second plates in pairs of each of the one or more cells form corrugations between the inlets and the outlets such that their ridges incline relative to the axis and that the ridges of corrugation of the first plate intersect the ridges of corrugation of the second plate.

Preferably, the first and second plates in pairs form semi-corrugations at the communication portions such that their ridges incline relative to the axis and that the ridges of the semi-corrugation of the first plate intersect the ridges of the semi-corrugation of the second plate.

Preferably, based on thermal expansion and contraction of the cell, the inner cylinder is capable of circumferentially relatively rotating relative to the outer cylinder.

Preferably, the first fluid is a high-temperature gas and the second fluid is a low-temperature gas, the second fluid surrounding the periphery of the outer cylinder such that it is led from the plurality of openings in the periphery of the outer cylinder into the interior of each of the one or more cells.

The internal pressure of the second fluid is preferably larger than that of the first fluid.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

The present invention will now be described with reference to the accompanying drawings which illustrate preferred embodiments thereof in a non-limitative manner.

Figure 1:
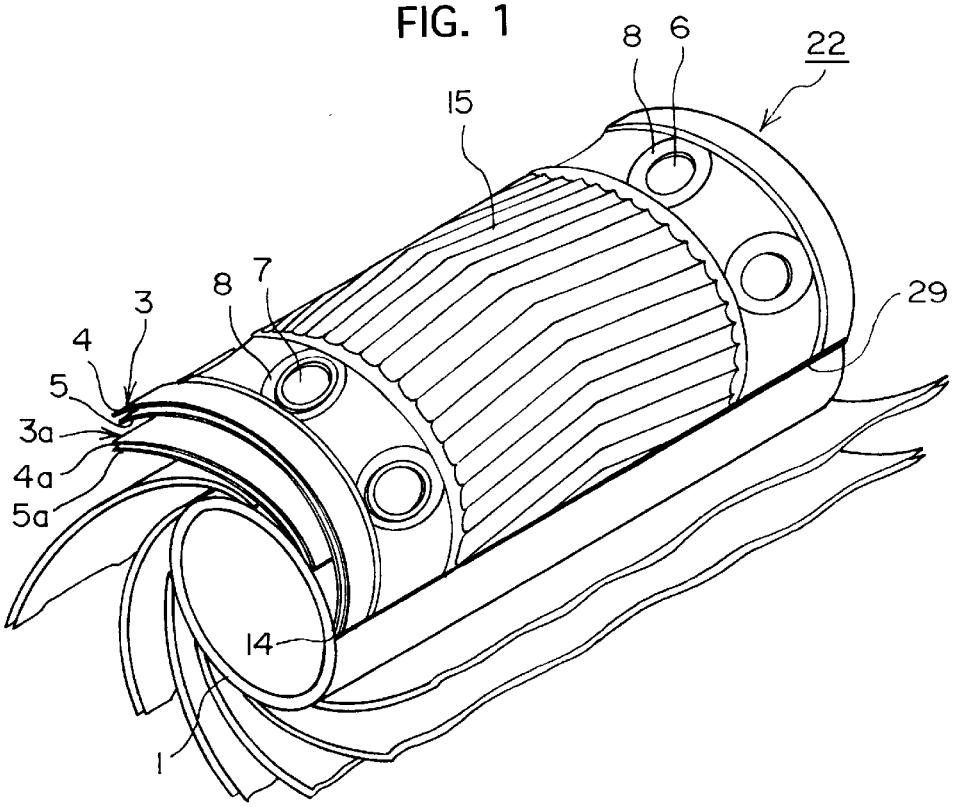
FIG. 1 is an explanatory, exploded perspective view of a core of a heat exchanger in accordance with the present invention.
Figure 2:
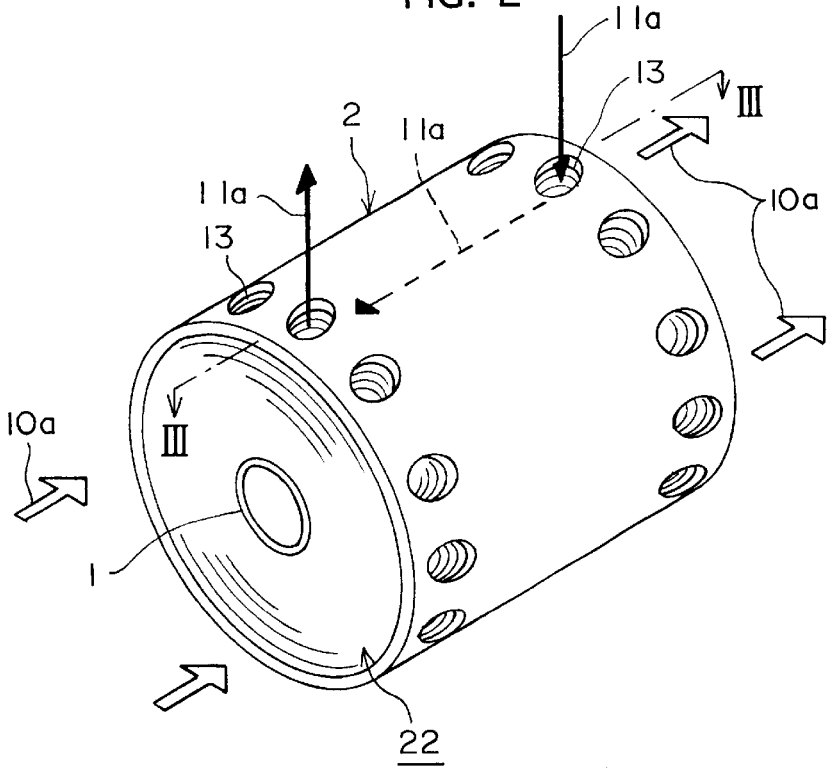
FIG. 2 is a perspective view of a major part of the heat exchanger.
Figure 3:
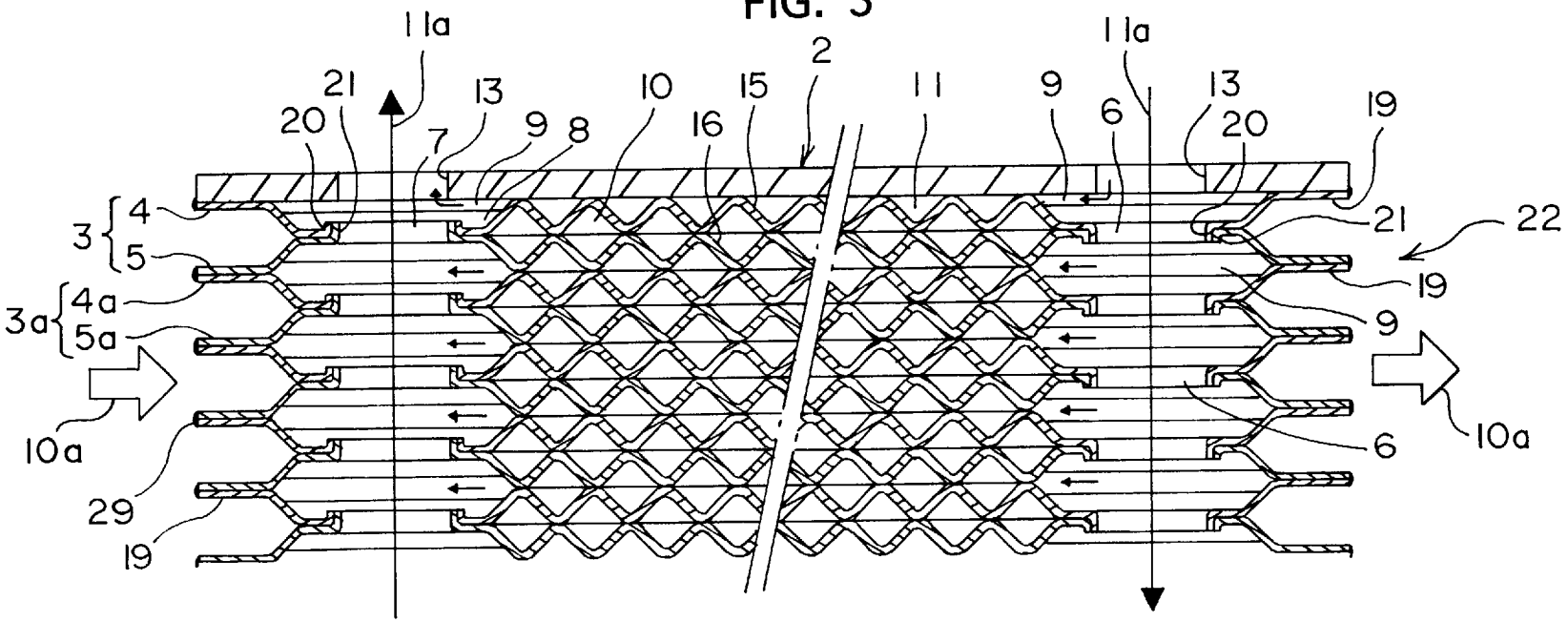
FIG. 3 is an enlarged sectional view taken along line III—III of FIG. 2.
Figure 4:
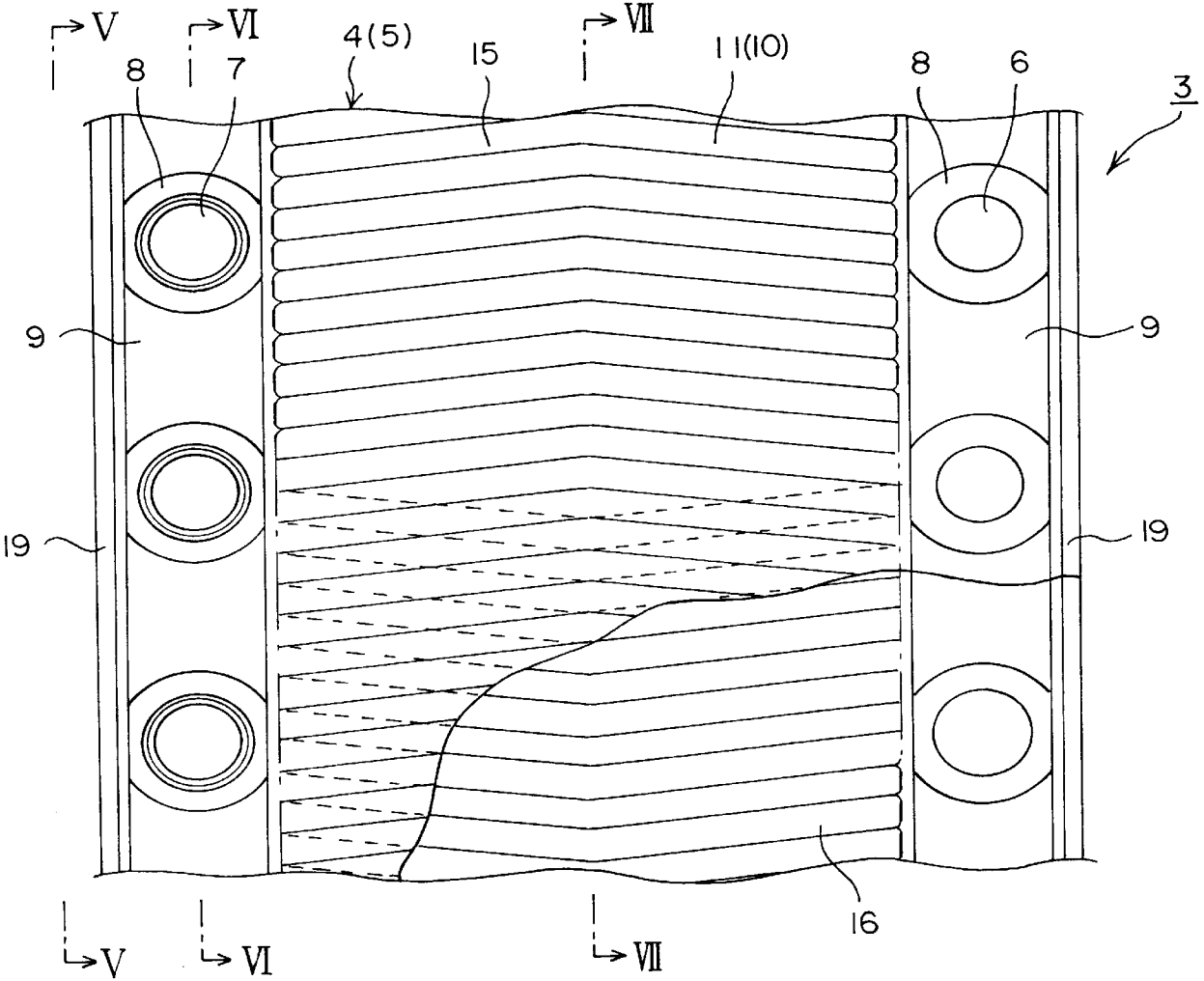
FIG. 4 is a top plan view of a major part, showing the developed state of a cell making up the heat exchanger.
Figure 5:
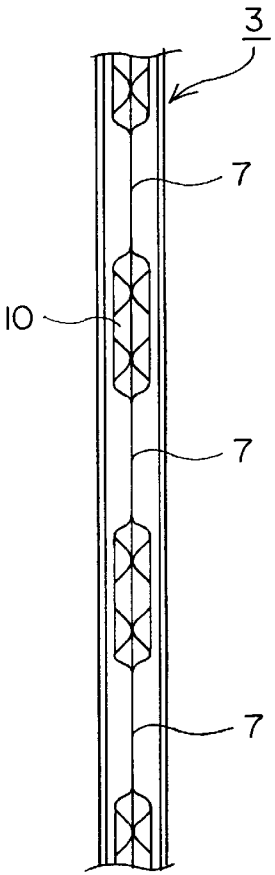
FIG. 5 is a diagram viewed from line V—V of FIG. 4.
Figure 6:
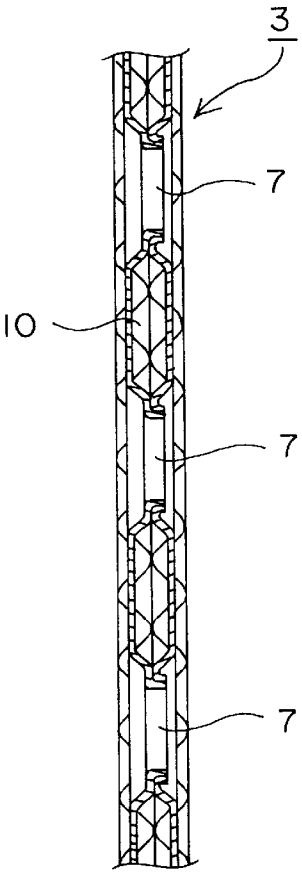
FIG. 6 is a diagram viewed from line VI—VI of FIG. 4.
Figure 7:
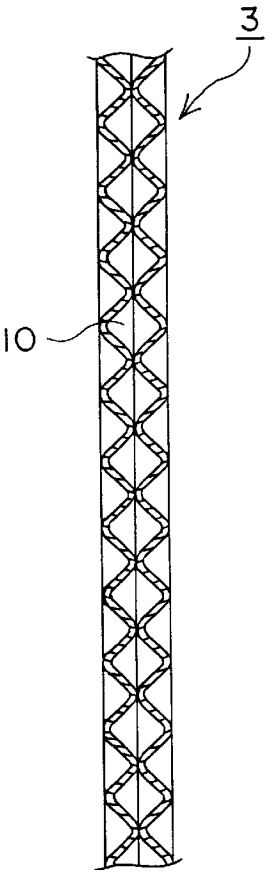
FIG. 7 is a diagram viewed from line VII—VII of FIG. 4.

FIG. 1 is an explanatory, exploded perspective view of a core 22 of a heat exchanger in accordance with the present invention; FIG. 2 is a perspective view of a major part of the heat exchanger; FIG. 3 is an enlarged sectional view taken along line III—III of FIG. 2; FIG. 4 is a top plan view of a major part, showing the developed state of a cell 3 making up the heat exchanger; FIG. 5 is a diagram viewed from line V—V of FIG. 4; FIG. 6 is a diagram viewed from line VI—VI of the same; and FIG. 7 is a diagram viewed from line VII—VII of the same.

The heat exchanger as shown in FIGS. 1 to 3 comprises an inner cylinder 1 and an outer cylinder 2 which are (substantially) concentrically arranged, and a multiplicity of cells 3 spirally wound between the inner cylinder 1 and the outer cylinder 2. The cell 3 is welded at its edge of one end 14 in the winding direction to the periphery of the inner cylinder 1 by means of laser welding, etc. The adjacent cells 3 and 3*a* are welded at their edges of the respective ends 14 to the periphery of the inner cylinder 1 in an equally spaced apart relationship in the circumferential direction of the inner cylinder 1.

Each cell 3 consists of a pair of plates, i.e., a first plate 4 and a second plate 5 which are in contact with each other. The first plate 4 and the second plate 5 are each formed with a multiplicity of circumferentially spaced apart inlets 6 and outlets 7 at plate opposed ends in the axial direction of the inner cylinder 1. The inlets 6 and outlets 7 lie within substantially circular recessed portions 8 extending in the direction where the first plate 4 and the second plate 5 confront each other. The first plate 4 and the second plate 5 are fitted to each other such that their respective outlets 7 register with each other and that their respective inlets 6 register with each other. More specifically, the first plate 4 has at its outlet 7 a slightly upwardly extending fitted portion 20 formed by burring, which receives a slightly upwardly extending fitting portion 21 of the second plate 5. At the inlets 6 the plates 4 and 5 are formed with slightly downwardly extending fitting portion 21 and fitted portion 20, respectively, which engage each other.

Shallow groove-shaped communication portions 9 extend between inlets 6 adjacent in the circumferential direction of the first plate 4 and the second plate 5. Small flanged portions 19 for joining are formed at edges extending axially outwardly from the communication portions 9. As seen in FIGS. 3 and 4, corrugations 15 are formed between the pair of, right and left communication portions 9 of the first plate 4 such that the ridges are shaped like inverted V's in top plan. Similarly, corrugations 16 are provided between the pair of communication portions 9 of the second plate 5 such that their ridges form V's which are opposite to those of the first plate 4. The plates 4 and 5 are then placed one on top of the other so that their respective corrugations 15 and 16 come into contact with each other in X's, with the result that a multiplicity of intersecting groove-shaped first flow passages 10 are provided within confronting surfaces of the first plate 4 and the second plate 5 so that the first fluid 10*a* described later flows therethrough. In the same manner, the second fluid passages 11 are formed on the non-confronting side so that the second fluid 11*a* flows therethrough.

In order to make up the shown cell 3 by use of the first plate 4 and the second plate 5, identical press molded belts are oppositely brought into back-to-back contact with each other such that ridges of the corrugations 15 and 16 intersect each other in X's and that their inlets are fitted to each other with their outlets fitted to each other. In this example, the inlets 6 and outlets 7 are welded at their respective rims to each other by use of laser, etc. The thus constructed cells 3 (including cells 3*a*) are welded at their ends 14 in the winding direction to the inner cylinder 1 to form welds 29 thereat as shown in FIGS. 1 and 2. The cells are then wound around the inner cylinder 1 such that the adjacent cells 3 and 3*a* are in intimate contact with each other, to make the core 2 around which the outer cylinder 2 is fitted. At opposed ends in its axial direction the outer cylinder 2 is formed with a multiplicity of circumferentially equally spaced apart openings 13.

The adjacent cells 3 and 3*a* are in contact with each other at their opposed end edges in the axial direction, which contacts form welds 29 by means of laser welding. More specifically, at the small flanged portion 19 for joining, the edge of the second plate 5 of the cell 3 on one hand comes into contact with the edge of the first plate 4*a* of the cell 3*a* on the other so that their edges are laser welded to each other.

Then the second flow passages 11 are formed on the non-confronting side of the paired first plate 4 and second plate 5 of each cell 3 itself so that the second fluid 11*a* flows therethrough.

In this manner, this example needs only welding of the rims of the inlet 6 and the outlet 7 of each cell and welding of contact end edges of the adjacent cells 3 and 3*a*, but allows the remaining portions to merely come into intimate contact with each other without any need for brazing.

In the cylinder-type heat exchanger of this embodiment of the present invention, the first fluid flows in the axial direction of the core 22 as shown in FIGS. 2 and 3 while moving through the first flow passages 10 of the cells 3 and 3*a* and passing from one end face of the core 22 through the other end face thereof. At one end and the other end in the axial direction of the core 22, the first flow passage 10 forms in each cell as shown in FIG. 5 so that the first fluid 10*a* flows therethrough into the interior and from the interior to the exterior.

The second fluid 11*a* flows via the right-hand opening 13 of the outer cylinder 2 through the inlets 6 into the interior of the second fluid 11 of each cell 3 as shown in FIGS. 2 and 3, after which it flows via the right-hand communication portions 9 (see FIG. 4) through the second flow passage 11 and exits via the left-hand communication portions 9 and the outlets 7 from the left-hand opening 13 of the outer cylinder 2.

The second fluid 11*a* introduced from the opening 13 of the outer cylinder 2 flows radially inwardly via the inlets 6 of the cells, while simultaneously it flows circumferentially via the communication portions 9 in the first plates 4 and the second plate 5 of the cells 3.

<Variant>

In the embodiment shown in FIG. 1, the plurality of cells 3 have been wound around the inner cylinder 1, but instead a single cell 3 may be wound a plurality of times around the inner cylinder 1. In this event, adjacent or adjoining cells can be construed to constitute an underlying portion of the cell a portion of the cell which overlies the underlying portion.

[Other Embodiments]

Reference is now made to FIGS. 8–18 to describe other embodiments of the present invention.

Figure 8:
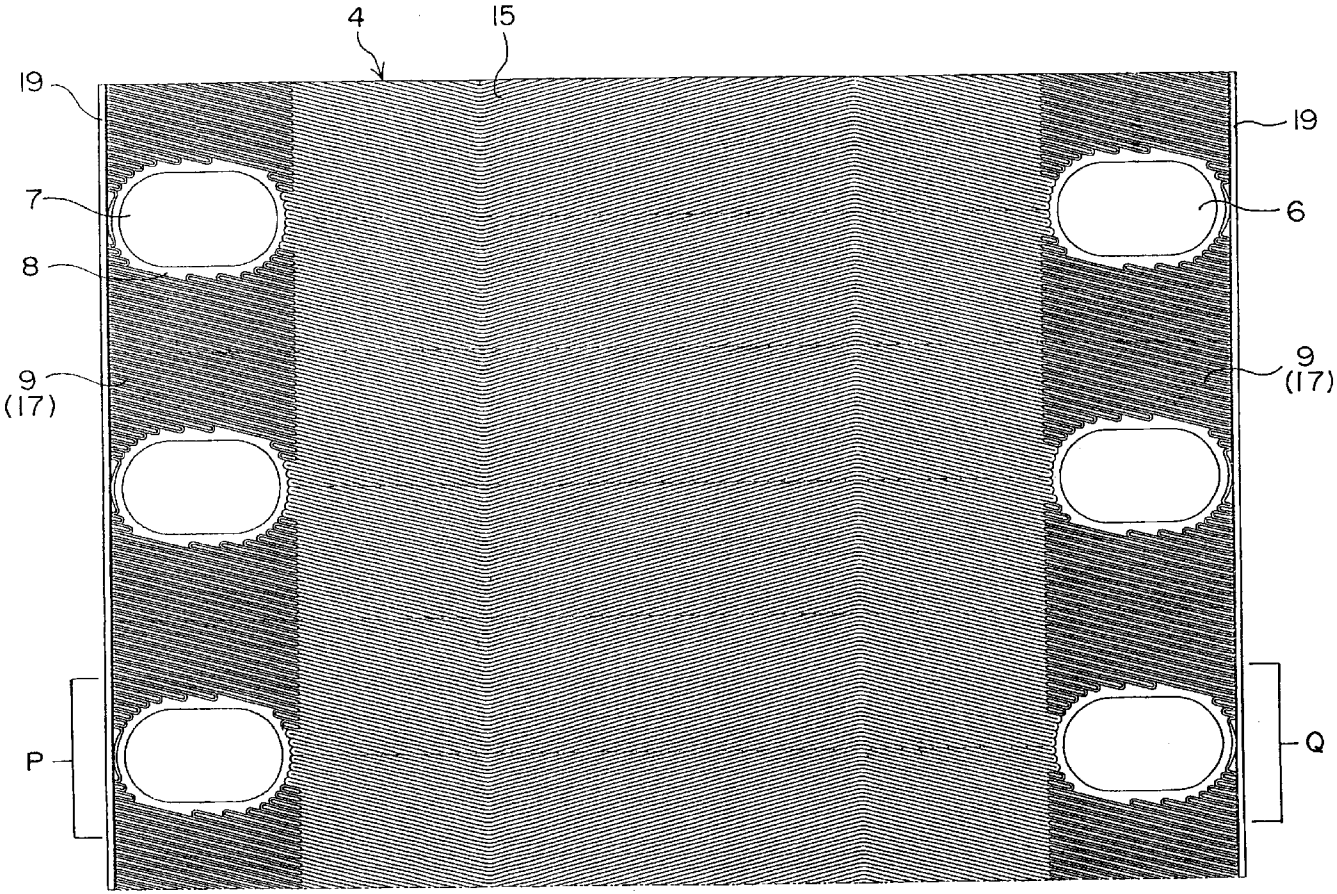
FIG. 8 is a top plan view of the developed state, showing another example of a first plate making up the cell of the cylinder-type heat exchanger of the present invention.
Figure 9:
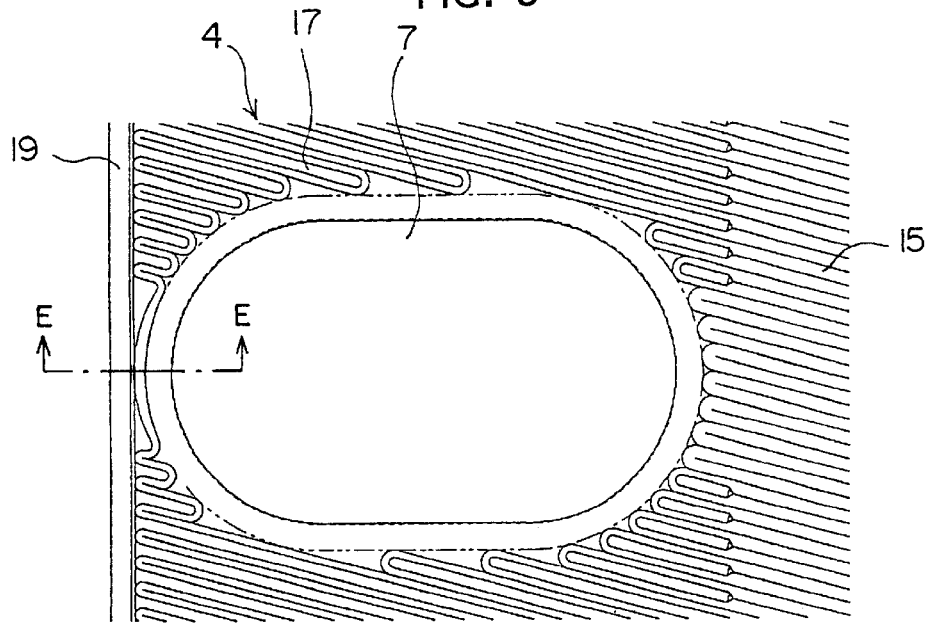
FIG. 9 is an enlarged view of a portion P of FIG. 8.
Figure 10:
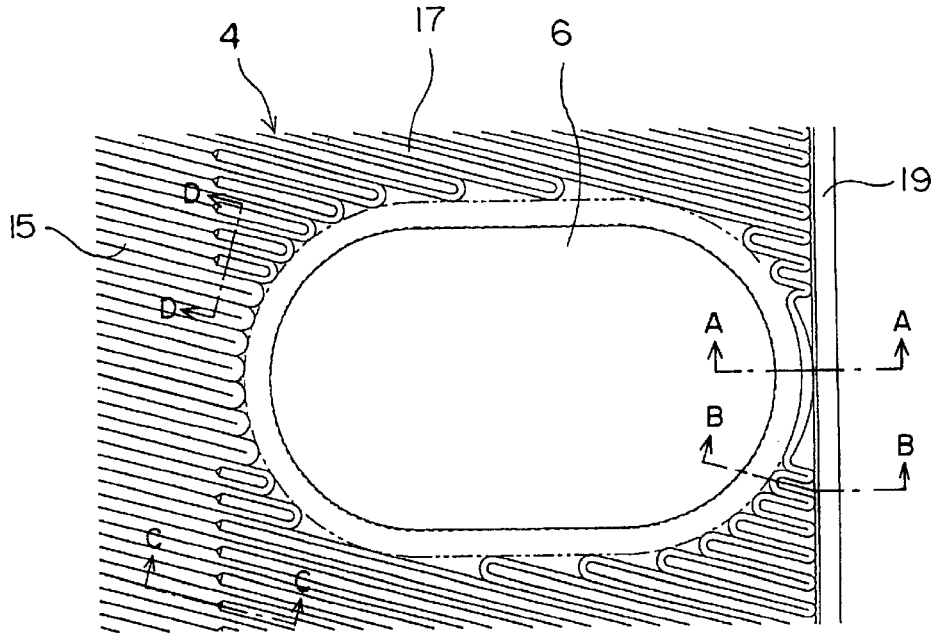
FIG. 10 is an enlarged view of a portion Q of FIG. 8.
Figure 11:
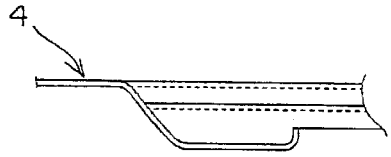
FIG. 11 is an enlarged sectional view taken along line E—E of FIG. 9.
Figure 12:
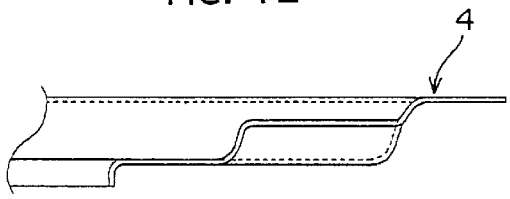
FIG. 12 is an enlarged sectional view taken along line B—B of FIG. 10.
Figure 13:
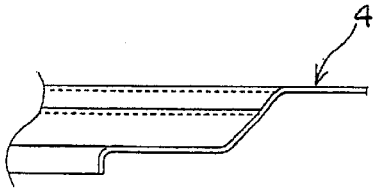
FIG. 13 is an enlarged sectional view taken along line A—A of FIG. 10.
Figure 14:
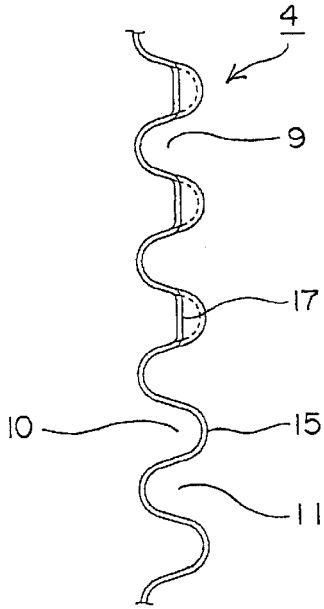
FIG. 14 is an enlarged sectional view taken along line D—D of FIG. 10.
Figure 15:
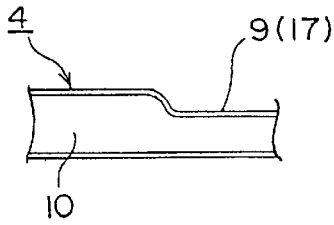
FIG. 15 is an enlarged sectional view taken along line C—C of FIG. 10.

FIG. 8 is a top plan view of the major part, showing the state where the first plate 4 is developed; FIG. 9 is an enlarged view of a portion P of FIG. 8; FIG. 10 is an enlarged view of a portion Q of FIG. 8; FIG. 11 is an enlarged sectional view taken along line E—E of FIG. 9; FIG. 12 is an enlarged sectional view taken along line B—B of FIG. 10; FIG. 13 is an enlarged sectional view taken along line A—A of FIG. 10; FIG. 14 is an enlarged sectional view taken along line D—D of FIG. 10; and FIG. 15 is an enlarged sectional view taken along line C—C of FIG. 10.

This first plate 4 differs from the first plate of FIG. 4 in that the paired right and left communication portions 9 are also formed with semi-corrugations 17, but the remainder are essentially the same. This is equivalent to one having corrugations with a half height (amplitude) at the groove bottom of the shallow groove-shaped communication portions 9. More specifically, these semi-corrugations 17 as shown in FIGS. 10 and 14 are formed on the internal surface side (second fluid 11*a* communication side/external fluid side) of the first plate 4. The semi-corrugations 17 have an amplitude equal to substantially a half of the amplitude of the corrugation 15 at the center in the axial direction of the first plate 4. As a result, the crest of the external surface side of the semi-corrugations 17 becomes level with the crest of the corrugations 15. The communication portions 9 are then formed on the internal surface side (second fluid 11*a* communication side) of the semi-corrugations 17 having a depth equal to a half of the height. Thus, arrangement is such that the second fluid 11*a* can move vertically between the vertically juxtaposed inlets 6 and between the vertically juxtaposed outlets 7 in FIG. 8.

Another such first plate 4 is prepared and rotated through 180 degrees around the center along the width of the plate 4, to form the second plate 5 of the present invention. Thus, the paired plates 4 and 5 are placed one on top of the other so that the inlets 6 are fitted to each other with the outlets 7 fitted to each other.

Figure 16:
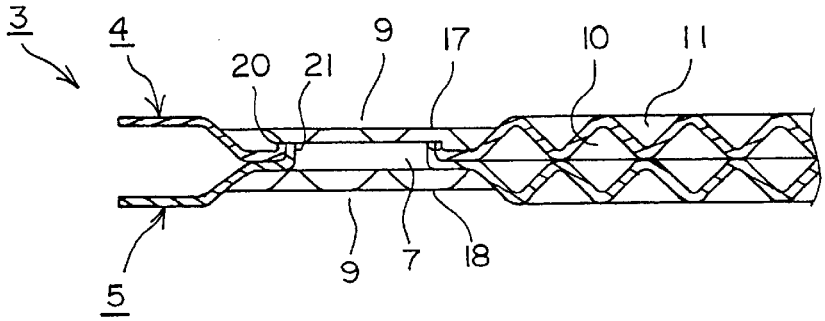
FIG. 16 is an explanatory sectional view at an outlet of a cell structure of the heat exchanger, which is made up of a first plate and a second plate in back-to-back contact with the first plate.
Figure 17:
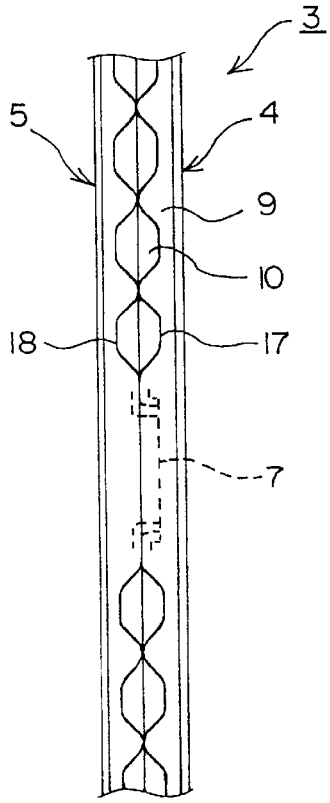
FIG. 17 is an explanatory side view of the cell.

FIGS. 16 and 17 show the cell 3 constructed by placing such the paired first plate 4 and the second plate 5 one on top of the other; FIG. 16 being an enlarged explanatory sectional view at the outlet 7 thereof, and FIG. 17 being an explanatory view of the left side of FIG. 16.

Figure 18:
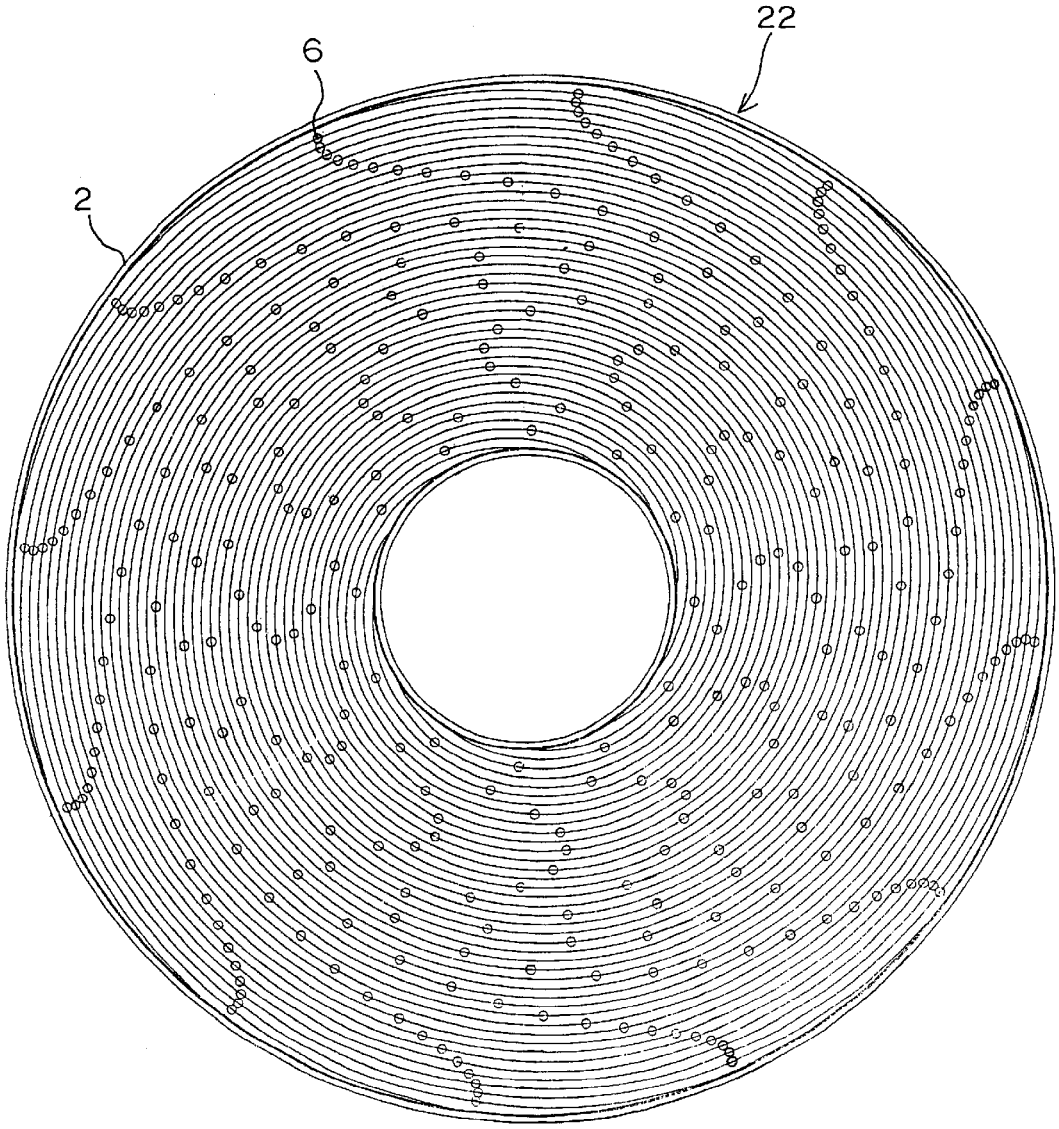
FIG. 18 is a side view of the core including a multiplicity of cells interposed between an inner cylinder and an outer cylinder.
Figure 19:
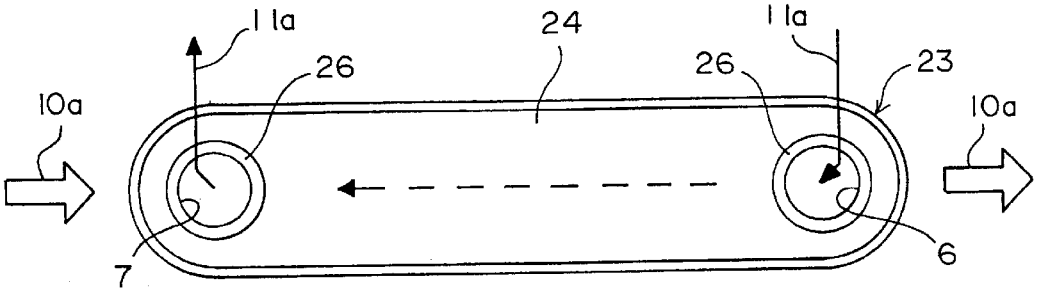
FIG. 19 PRIOR ART
FIG. 19 is a top plan view of an element of a conventional recuperator for a gas turbine.
Figure 20:
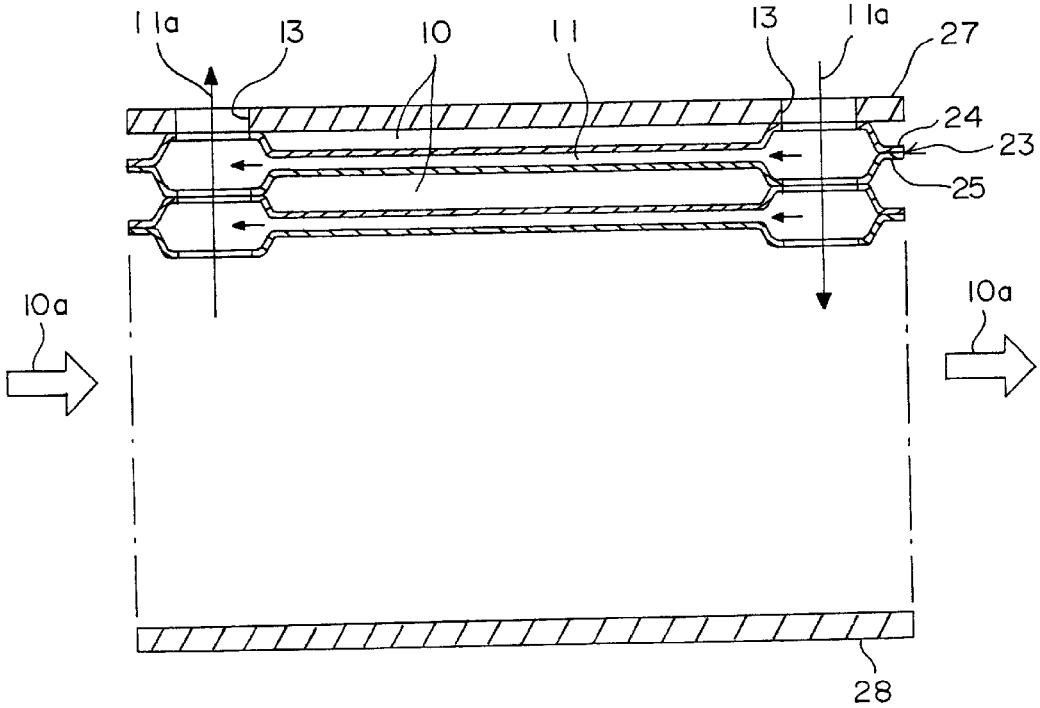
FIG. 20 PRIOR ART
FIG. 20 is a schematic, longitudinal sectional view of the recuperator including a multiplicity of the elements.

FIG. 18 shows by way of example an assembly including twelve (12) cells 3 shifted by 30 degrees and wound around the inner cylinder 1 in an intimate contact manner with their respective ends welded to the periphery of the inner cylinder 1 such that the outermost cell 3 is covered with the outer cylinder 2.

In the core 22 of FIG. 18, the inlets 6 are indicated by a multiplicity of small circles (similar outlets are present on the opposite side in the axial direction), with the inlets 6 of the adjacent cells being laid one upon the other at the outermost periphery but spaced apart farther from each other accordingly as it goes toward the center. However, the second fluid 11*a* entering the outermost cell 3 is smoothly led through the inlets 6 of all the cells toward the center in the radial direction.

The reasons therefor are described as follows with reference to FIGS. 3 and 4.

First, the second fluid 11*a* fed to the inlet 6 of the outermost cell 3 enters via that inlet 6 into the interior of the communication portion 9 of the underlying cell 3*a* and moves in the circumferential direction. Then at the third outermost cell 3, the second fluid 11*a* flows from its communication portion 9 via a proper inlet 6 into the cell 3 closer to the center and is in succession led toward the center.

Within each cell, the second fluid 11*a* flows from the right-hand communication portion 9 through the second flow passage 11 to reach the left-hand communication portion 9, which in turn moves from the left-hand communication portion 9 via a proper outlet 7 to the upper layer cell 3, for the delivery from the opening 13 of the outer cylinder 2 to the exterior.

Due to one or more cells 3 being spirally wound between the inner cylinder 1 and the outer cylinder 2, the cylinder-type heat exchanger of the present invention an increase the circumferential lengths of the first plate 4 and the second plate 5 and have a less number of components for easy assembly. In addition, it can be a heat exchanger which is compact but has an increased heat radiation area and thus an excellent heat exchanging ability. Especially, in cases where the first fluid 10*a* flows cylindrically along the axial direction through the cylindrical interior, it can be a space-saving heat exchanger. Furthermore, it can be a heat exchanger having a reduced resistance to communication.

In view of its configuration where the periphery of the outer cylinder 2 is provided with a plurality of openings 13 for outflow and inflow of the second fluid 11*a* which are in communication with the inlets 6 and outlets 7 of the cells 3, the cylinder-type heat exchanger can be a heat exchanger having a simple structure and less likely to leak.

In another embodiment of the invention, the first plate 4 and the second plate 5 of the cell 3 are welded at their inlets 6 and the outlets 7, with the adjacent cells 3 and 3*a* being joined plate-to-plate joined at opposed edges 4 in the axial direction. The remainder arc not joined plate-to-plate. This eliminates the need for a lot of brazing materials as in the prior art, which can reduce the production costs accordingly.

In another embodiment of the invention the ends in the winding direction of the plurality of cells 3 and 3*a* are joined to the periphery of the inner cylinder 1 in a relation relative relationship in which they are spaced apart circumferentially about the inner cylinder 1, whereby the relative positions of the adjacent cells can be stabilized, presenting a heat exchanger having a high reliability.

In another embodiment of the invention, the paired plates have the corrugations 15 and 16 formed between the inlets 6 and the outlets 7 such that the corrugation 15 of the first plate 4 intersects the corrugation 16 of the second plate, thereby stirring the fluids for the improvement of the heat exchanging ability.

In another embodiment of the invention, the first plate 4 and the second plate 5 have their respective semi-corrugations 17 and 18 at the communication portions 9, whereby heat exchange can be promoted between first fluid 10*a* and the second fluid 11*a* flowing through those portions.

In another embodiment of the invention, the inner cylinder 1 is capable of rotating circumferentially relative to the outer cylinder 2, based on the thermal expansion and contraction of each cell, so that the thermal expansion and contraction of each cell can be absorbed to provide a heat exchanger having a long service life.

In another embodiment of the invention, the second fluid 11*a* in the form of a low-temperature gas surrounds the periphery of the outer cylinder 2 and the first fluid 10*a*, a high-temperature gas, is led into the interior, thereby preventing heat from dissipating outward of the outer cylinder 2 to reduce the amount of use of heat insulating materials.

In another embodiment of the invention, the second fluid 11*a* surrounding the outer cylinder 2 has an internal pressure larger than that of the first fluid 10*a* introduced into the interior, thereby presenting a heat exchanger with a high durability while keeping the shape of the outer cylinder 2.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A cylinder-type heat exchanger comprising:

an inner cylinder and an outer cylinder which are concentrically ranged; and a plurality of cells arranged between said inner and outer cylinders and spirally wound therebetween;

each of said cells including a first plate and a second plate in pairs which are in contact with each other;

said first and second plates in each of said pairs each being provided with a plurality of circumferentially spaced apart inlets and outlets at opposed ends in an axial direction of said inner cylinder, said plurality of inlets and outlets lying within recessed potions formed opposite one another in said first and second plates such that said plurality of inlets register with one another and said plurality of outlets register with one another;

each of said cells including communication portions arranged between circumferentially adjoining inlets and between circumferentially adjoining outlets of said first plate and said second plate;

said first and second plates in each of said pairs being provided on confronting sides with a first flow passage for communication of a first fluid extending in said axial direction, said first and second plates in each of said pairs being provided on non-confronting sides with a second flow passage for communication of a second fluid extending from said inlets to said outlets in said axial direction; and said second plate of one of radially adjoining cells and said first plate of another of said radially adjoining cells being in contact with each other at their opposed edges in said axial direction, said recessed portions of said first and second plates confronting each other to form a second fluid inflow/outflow part.

2. The cylinder-type heat exchanger according to claim 1, wherein the periphery of said outer cylinder is provided with a plurality of openings for outflow and inflow of said second fluid which communicate with said inlets and outlets of said cells.

3. The cylinder-type heat exchanger according to claim 1 or 2, said first plate and said second plate in pairs of each of said cells are welded inlet-to-inlet and outlet-to-outlet to each other, said second plate of one of adjoining cells and said first plate of another of said adjoining cells being welded to each other at their opposed edges in said axial direction, with said plates being substantially free from join being joined at remaining portions.

4. The cylinder-type heat exchanger according to claim 1 or 2, wherein said cells are joined at their ends in a winding direction to the periphery of said inner cylinder in a circumferentially spaced apart relationship.

5. The cylinder-type heat exchanger according to claim 1 or 2, wherein said first and second plates in pairs of each of said one-or-more cells form corrugations between said inlets and said outlets such that ridges of said first and second plates incline relative to said axial direction and ridges of corrugation of said first plate intersect ridges of corrugation of said second plate.

6. The cylinder-type heat exchanger according to claim 1 or 2, wherein said first and second plates in pairs form semi-corrugations at said communication portions such that ridges of said first and second plates incline relative to said axial direction and ridges of said semi-corrugation of said first plate intersect ridges of said semi-corrugation of said second plate.

7. The cylinder-type heat exchanger according to claim 4, wherein based on thermal expansion and contraction of said cells, said inner cylinder is capable of circumferentially relatively rotating relative to said outer cylinder.

8. The cylinder-type heat exchanger according to claim 2, wherein said first fluid is a high-temperature gas and said second fluid is a low-temperature gas, said second fluid surrounding the periphery of said outer cylinder such that it flows from said plurality of openings in the periphery of said outer cylinder into the interior of each of said cells.

9. The cylinder-type heat exchanger according to claim 8, wherein the internal pressure of said second fluid is larger than the internal pressure of said first fluid.

10. The cylinder-type heat exchanger according to claim 1, wherein said communication portions of each of said cells are configured such that first ones of said communication portion associated with said inlets of said cell are arranged on one side of said second flow passage and second ones of said communication portions associated with said outlets of said cell are arranged on an opposite side of said second flow passage to cause the second fluid to flow into one of said first communication portions, through said second flow passage and ten into one of said second communication portions.

11. The cylinder-type heat exchanger according to claim 1, wherein said communication portions are shallow and groove-shaped and extend between all of the circumferentially adjoining inlets and between all of the circumferentially adjoining outlets of said first plate and said second plate in each of said cells to thereby enable circumferential flow of the second fluid around said cells.

12. The cylinder-type heat exchanger according to claim 1, wherein said communication portions each extend circumferentially around a part of said cell between a pair of adjoining inlets or adjoining outlets.

13. The cylinder-type heat exchanger according to claim 1, wherein in each of said cells, said first plate has an upwardly extending fitted portion at each outlet and said second plate has an upwardly extending fitting portion at each outlet received within said fitting portion of a registering one of said outlets of said first plate.

14. The cylinder-type heat exchanger according to claim 1, wherein in each of said cells, said first plate has a downwardly extending fined portion at each inlet and said second plate has an downwardly extending fitting portion at each inlet in which said fitting portion of a registering one of said inlets of said first plate is received.

15. The cylinder-type heat exchanger according to claim 1, wherein said recessed portions of each of said cells communicate with said communication portions of said cell.

* * * * *